US007384902B2

(12) United States Patent
Chernin et al.

(10) Patent No.: US 7,384,902 B2
(45) Date of Patent: Jun. 10, 2008

(54) METAL BRIGHTENER AND SURFACE CLEANER

(75) Inventors: Vladimir Chernin, Green Bay, WI (US); Ronald W. Kubala, Green Bay, WI (US); Richard Martens, Green Bay, WI (US)

(73) Assignee: Cleaning Systems, Inc., De Pere, WI (US)

( * ) Notice: Subject to any disclaimer, the term of this patent is extended or adjusted under 35 U.S.C. 154(b) by 74 days.

(21) Appl. No.: 10/846,212

(22) Filed: May 14, 2004

(65) Prior Publication Data

US 2005/0256025 A1 Nov. 17, 2005

(51) Int. Cl.

| | |
|---|---|
| ***C11D 1/88*** | (2006.01) |
| ***C11D 1/66*** | (2006.01) |
| ***C11D 3/02*** | (2006.01) |
| ***C11D 3/26*** | (2006.01) |

(52) U.S. Cl. ..... 510/264; 510/245; 510/272; 510/477; 510/488; 510/505

(58) Field of Classification Search ..... None
See application file for complete search history.

(56) References Cited

U.S. PATENT DOCUMENTS

| | | | | |
|---|---|---|---|---|
| 5,531,933 | A * | 7/1996 | Masters et al. | 510/429 |
| 6,284,723 | B1 * | 9/2001 | Zhou et al. | 510/384 |
| 6,376,448 | B1 * | 4/2002 | Colurciello et al. | 510/384 |
| 6,420,326 | B1 * | 7/2002 | Maile et al. | 510/181 |
| 6,432,892 | B2 * | 8/2002 | Meine et al. | 510/111 |
| 6,593,288 | B2 * | 7/2003 | Aubay et al. | 510/504 |
| 2002/0147124 | A1 * | 10/2002 | Klos et al. | 510/447 |
| 2004/0121932 | A1 * | 6/2004 | Griese et al. | 510/417 |

* cited by examiner

*Primary Examiner*—Gregory R Del Cotto
(74) *Attorney, Agent, or Firm*—Nancy R. Gamburd; Richard J. Botos; Gamburd Law Group LLC

(57) ABSTRACT

The present invention provides a metal brightener and surface cleaner, which provides significant etching of aluminum and other metals, without detrimentally affecting other surfaces such as painted surfaces, glass, rubber and plastic. The inventive composition is especially suited for aluminum brightening for large vehicles, and may be utilized in an alkaline step of a multi-step vehicle wash. One of the exemplary compositions includes an alkali metal hydroxide; a polycarboxylic acid; an alkali metal salt of an organic acid; a first, amphoteric surfactant; a second, betaine surfactant; and a third, nonionic surfactant.

18 Claims, No Drawings

METAL BRIGHTENER AND SURFACE CLEANER

FIELD OF THE INVENTION

The present invention is related, in general, to compositions both for brightening metals such as aluminum and for cleaning such metals and other surfaces, such as painted surfaces, without harming such other surfaces that can not conveniently be protected against contact with the same composition. More particularly, the invention is related to compositions utilized for brightening and cleaning large vehicles having metallic surfaces, such as aluminum and stainless steel, and a wide variety of other surfaces, such as painted surfaces, glass, rubber, plastic, and fiberglass.

BACKGROUND OF THE INVENTION

Many vehicles of all types often use metals and metal alloys (referred to herein interchangeably), particularly stainless steel and aluminum alloys, without any protective coating of a paint or a similar material, because of the aesthetical appeal of the natural metallic luster. Examples include aluminum alloy wheels for automobiles; various alloys of aluminum or stainless steel for gasoline tanks, trim and exhaust pipes for large trucks, and various alloys of aluminum or stainless steel for parts and trim on boats and ships. The metallic luster may be marred by accumulated soils of various types, including: oily soils, mineral soils, innumerable types of organic and inorganic matter, mud, tar, grease, oil, and virtually any other item which may be found in a transportation environment, for automobiles, trucks, trains, boats, and ships. Additionally, the metal alloys may become tarnished or otherwise lose their brilliance by build-up of natural oxide layers from the environment. As a consequence, periodic brightening is necessary to maintain the aesthetic appeal of these metallic surfaces.

Metal alloys, particularly aluminum alloys, may be brightened through microscopic or otherwise moderate etching, in which a selected composition or solution reacts with the metallic surface and removes a microscopic layer of the metal. Prior art alkaline and/or acidic solutions may have the unwanted result of irregular, non-uniform etching of the aluminum, with the potential for leaving pits or pock marks on the aluminum. In addition, such prior art alkaline and/or acidic solutions do not provide an effective means to control the etching rate and, again, produce irregular, non-uniform etching of aluminum and other metallic surfaces.

Prior art alkaline and/or acidic solutions used in the aluminum brightening process also require high concentrations of surfactants and other components. See, e.g., U.S. Pat. No. 4,762,638, discussed below. In order to improve etching performance, increased concentrations of all or most components are required, resulting in solutions having higher total concentrations in order to reach a desired rate of etching. These higher concentration solutions result in higher material costs, without providing adequate or sufficient performance for aluminum brightening.

Prior art acidic solutions used for cleaning and/or aluminum brightening typically contain a mineral acid, such as hydrofluoric acid (HF). These hydrofluoric acid detergents are highly corrosive, both to the vehicle and to the vehicle wash facility, are toxic to consumers and the environment, are dangerous to make, ship, and use, and may be otherwise damaging to a vehicle's surface.

Prior art alkaline solutions also may have the further unwanted effect of damaging other, adjacent surfaces. Use of those solutions requires masking of these other surfaces, such as glass or paint, prior to the application of such prior art alkaline solutions. Considerable time and effort is required to perform the masking, resulting in increased costs, and an increased risk of damaging these other surfaces.

A need remains, therefore, for a composition which provides brightening and cleaning for aluminum and other metals, with controlled and uniform etching in a relatively short period of time, such as the several minutes of a commercial vehicle wash. The composition should be non-toxic, and should not adversely affect other surfaces, such as painted surfaces, that may be in close proximity to the aluminum or other metal. In addition, such a composition should also have a cleaning effect for these other surfaces. Furthermore, a need remains for a low concentration solution which performs as effectively, or even more effectively, than current, prior art high concentration solutions.

SUMMARY OF THE INVENTION

The exemplary compositions of the present invention provide new brightening and/or cleaning compositions for aluminum and other metals. In accordance with the present invention, an aluminum brightener and cleaner is provided which utilizes an organic acid, such as a polycarboxylic acid, with various surfactants, and with an alkali metal hydroxide, such as sodium hydroxide and an alkali metal salt of an organic acid, such as sodium glucoheptonate. The brightening and cleaning composition of the invention provides equal and/or significantly more effective etching rates or brightening properties, at a selectable and controllable rate, at lower concentrations, and does so not only without adversely affecting surfaces adjacent to the metal surface desired to be brightened, but also while providing effective cleaning for these surfaces. The brightening and cleaning composition of the invention also provided unexpected empirical results compared to prior art cleaning compositions.

An exemplary embodiment of the metal brightening or cleaning composition of the invention comprises an alkali metal hydroxide (such as sodium hydroxide or potassium hydroxide); a polycarboxylic acid (such as EDTA or PDTA); an alkali metal salt (such as an alkali metal salt of an organic acid); a first, amphoteric surfactant; and a second surfactant. The concentration of the first, amphoteric surfactant is selected to correspond to a rate of etching of aluminum or other metal. The second surfactant may be nonionic, cationic, or anionic. The second surfactant generally also includes a betaine surfactant, such as alkyl betaine, alkylamidopropyl betaine, or imidozolinium betaine, and the concentration of betaine may also be selected to correspond to a rate of etching of aluminum or other metal. A third surfactant, such as a nonionic surfactant, may also be included.

Among the various unexpected results provided by the present invention are a first empirically determined ratio, between the alkali metal hydroxide and polycarboxylic acid, of substantially from 0.6:1 to 6:1, and most advantageously 2:1; and a second unexpected, empirically determined ratio, between the alkali salt of an organic acid and the polycarboxylic acid, of also substantially from 0.6:1 to 6:1, and most advantageously 2:1.

Another exemplary aluminum brightening composition comprises: an alkali metal hydroxide having a concentration of substantially 1.6 to 16 g/l; a polycarboxylic acid having a concentration of substantially 0.9 to 9 g/l; an alkali metal salt of an organic acid having a concentration of substantially 1.4 to 14 g/l; a first, amphoteric surfactant having a concentration of substantially 0.03 to 3 g/l; a second, betaine surfactant; a third, nonionic surfactant, the second betaine surfactant and the third nonionic surfactant having a combined concentration of substantially 0.1 to 1.8 g/l; and the balance being water.

Numerous other advantages and features of the present invention will become readily apparent from the following detailed description of the invention and the embodiments thereof, from the claims and from the empirical test results.

DETAILED DESCRIPTION OF EXEMPLARY EMBODIMENTS OF THE INVENTION

While the present invention is susceptible of embodiment in many different forms, there will be described herein in detail specific embodiments thereof, with the understanding that the present disclosure is to be considered as an exemplification of the principles of the invention and is not intended to limit the invention to the specific embodiments illustrated.

As indicated above, a need exists for a new brightening and/or cleaning composition for aluminum and other metals that is highly effective in truck and other large vehicle maintenance, but which does not require high concentrations of material and which does not adversely affect other surfaces (such as painted surfaces) that may be in close proximity to the metal surface requiring brightening and, in fact, may clean those surfaces as well. In accordance with the present invention, an aluminum brightener and cleaner is provided which utilizes an organic acid, such as a polycarboxylic acid, with various surfactants, and with an alkali metal hydroxide, such as sodium hydroxide and an alkali metal salt of an organic acid, such as sodium glucoheptonate. The brightening and cleaning composition of the invention provides equal and/or significantly more effective etching rates or brightening properties, at a selectable and controllable rate, and does so with lower concentration solutions. In addition, not only does the brightening and cleaning composition of the invention avoid adversely affecting surfaces adjacent to the metal surface desired to be brightened, it also provides effective cleaning for these surfaces, such as glass, painted surfaces, rubber, plastic, brass, fiberglass, and possibly wood, brick and stone. As discussed in greater detail below, moreover, the brightening and cleaning composition of the invention provided unexpected empirical results compared to prior art cleaning compositions.

In addition to being used as a stand-alone brightener, the brightening and cleaning composition of the present invention may be utilized in a multi-part cleaning process, first involving the application of an acidic composition, followed by a variable dwell time, followed by the application of the brightening and cleaning composition of the invention, followed by a variable dwell time, and then followed by high pressure water rinsing. For example, the brightening and cleaning composition of the present invention may be utilized with the acidic composition disclosed in V. Chemin et al., U.S. Pat. No. 6,696,399 B1, issued Feb. 24, 2004, and incorporated herein by this reference. The brightening and cleaning composition of the present invention is especially effective at removing various soils associated with large transportation vehicles, including various oils, mineral soils, innumerable types of organic and inorganic matter, mud, tar, and grease.

The terms "surface active agent", "detergent", "surfactant" and "emulsifier", as used herein have their ordinary meaning as is well known in the detergent, surface cleaning, and emulsion arts.

In one aspect, the present invention provides a composition for brightening aluminum and other metals, especially those metals used in large vehicles, such as large trucks. Exemplary compositions contain at least one surface active agent, from 0.9 to 9.4 g/l of polycarboxylic acid, 1.6 to 16.3 g/l of an alkali metal hydroxide, and 1.4 to 14.3 g/l of an alkali salt of an organic acid. Additional surface active agents include surfactants, such as a nonionic surfactant, an amphoteric surfactant, or betaine. Exemplary compositions also may include a plurality of surface active agents, including at least two surfactants; generally, at least one of the two surfactants is an amphoteric surfactant.

A first exemplary embodiment of the brightening and cleaning composition of the invention comprises, approximately, in grains/liter:

1. An alkali metal hydroxide, 1.6 to 16 g/l;
2. A polycarboxylic acid, 0.9 to 9 g/l, such as a polycarboxylic acid having the formula $(CH_2CH_2O)_aN_b(CH_2)_c(CH_2COOH)_d$, with a=(0 to 1), b=(1 to 3), c=(0 to 4), and d=(3 to 5);
3. An alkali metal salt of an organic acid, 1.4 to 14 g/l, such as an alkali metal salt of an organic acid having formula $C_nH_{2n+1}O_{n+1}Me$ with n=(5 to 8) (or n=(6 to 7)); and
4. At least two surfactants, wherein one surfactant is an amphoteric surfactant in the amount of approximately 0.03 to 3 g/l; and one or more second surfactants in the amount of approximately 0.1 to 1.8 g/l.

One or more of these second surfactants is generally a nonionic surfactant and a cationic/amphoteric surfactant (such as betaine).

The following discussion is applicable to all compositions discussed herein, unless otherwise stated. It should be understood that the balance of the exemplary composition is water. It will be understood by those of skill in the art that equivalent units of measurements, such as by molarity or molality, or by percentage weights, may be substituted and are within the scope of the present invention. It should also be noted that the g/l concentrations listed above are for active ingredients, forming a concentrated solution. Depending upon the form and concentration of any components from a given supplier, these listed concentrations of the present invention are likely to be varied (e.g., sodium hydroxide may be supplied as a 50% concentrated solution and, in which case, the g/l ranges for the alkali metal hydroxide should be modified accordingly). It will also be understood by those of skill in the art that the composition of the invention may be diluted to any desired strength, preferably by water, throughout a wide range. Exemplary embodiments of the brightening and cleaning composition of the invention are typically diluted in the exemplary application of large vehicle washing, typically in a wide range of 1:5 to 1:50, and in some applications, as much as 1:100 or more.

As discussed in greater detail below, comparison experiments were performed utilizing this exemplary brightening and cleaning composition of the invention. The various exemplary brightening and cleaning compositions of the invention, as illustrated below, provided unexpectedly favorable empirical results in comparison with the compositions of the prior art, resulting in exceptional aluminum brightening capability.

Additional experimentation also revealed further unexpected results, namely, certain favorable ratios of components, for maximal or optimal etching capability, without simultaneously harming other surfaces, such as nearby or adjacent painted surfaces. One such unexpected, empirically determined ratio, between the alkali metal hydroxide and polycarboxylic acid, is substantially from 0.6:1 to 6:1, and most advantageously 2:1. A second unexpected, empirically determined ratio, between the alkali salt of an organic acid and the polycarboxylic acid, is also substantially from 0.6:1 to 6:1, and most advantageously 2:1. It should be noted that while etching nonetheless occurs outside of these ratios, it occurs at a decreased rate and/or decreased amount.

As indicated above, an exemplary embodiment of the brightening and cleaning composition of the invention contains from 0.1 to 1.8 g/l of a nonionic surfactant, as a second surfactant. Exemplary nonionic surfactants utilized in the brightening and cleaning composition of the invention include ethoxylated C8-C18 alkylphenols or condensation products of higher alcohol condensed with about 2 to 14 moles of ethylene oxide ("EO"), for example: lauryl or myristyl alcohol condensed with 6 moles of ethylene oxide; tridecanol condensed with about 2 to 20 moles of EO; the condensation product of EO with a cut of coconut fatty alcohols with alkyl chain varying from 10 to about 14 carbon atoms in length and wherein, in condensate, contains either about 2 moles of EO per mole of total alcohol or about 20 moles of EO per mole of alcohol.

An exemplary group of the foregoing nonionic ethoxylated alkylphenols are the Surfonic® N ethoxylates (Surfonic is a registered trademark of Huntsman LLC), which are alpha-(alkylphenol) containing about 9-15 carbon atoms/molecule, such as nonylphenol condensed with 2-3 moles of ethylene oxide (Surfonic N-31.5), or nonylphenol condensed with 8-9 moles of EO (Surfonic N-85).

Additional nonionic surfactants which may be utilized in the brightening and cleaning composition of the invention, such as oil soluble alcohol ethylene oxide condensates, are the condensation products of secondary aliphatic alcohol containing 8 to 18 atoms/molecule in a straight or branched chain configuration condensed with 2 to 20 moles of EO. Examples of commercially available nonionic surfactants (detergents) of the foregoing type are C11-C15 secondary alcohol condensed with either 5 EO (Tergitol™ 15-S-5) or 9 EO (Tergitol 15-S-9). Tergitol is a trademark of the Dow Chemical Company of Midland Mich.

Yet additional nonionic surfactants are the Tomadol® ethoxylates (Tomadol is a registered trademark of Tomah Products of Milton Wis.), which are higher aliphatic, primary alcohol containing 9-15 carbon atoms/molecule condensed with 2-4 moles of ethylene oxide (Tomadol 23-3), C12-C15 alcohol condensed with 2-4 moles of EO (Tomadol 25-3), C14-C15 linear primary alcohol condensed with 2-3 moles of ethylene oxide (Tomadol 45-2.25).

As indicated above, an embodiment of the brightening and cleaning composition of the invention contains from 0.03 to 4.1 g/l of an amphoteric surfactant, as a first surfactant. Exemplary amphoteric surfactants used in the inventive compositions contain two charged groups of opposite polarity, in which the positive charge is usually from ammonium, while the source of negative charge may vary. The amphoteric surfactant for the exemplary compositions is one that changes from cationic (via zwitterionics) to net anionic, as pH changes from low to high pH. Exemplary amphoteric surfactants of the present invention include N-trialkyl derivatives of simple amino acids (alkylamidopropyl hydroxysultaine, alkylamidopropyl hydroxyphostaine); N-alkyl derivatives of amino acids or imino acids (alkyl aminopropionic acid, alkali salt of alkylglycinate, aminopropyl alkylglutamide, alkali salt of alkyliminodipropionate); acyl ethylenediamines and derivatives (acylamphoacetate, acylamphodiacetate and acylamphodipropionate). Other examples of amphoteric compounds, which may be suitable for use in accordance with the present invention, may be found in E. G. Lomax, Amphoteric Surfactants, Marcel Dekker, New York, 1996.

Betaine is also an exemplary (second) surfactant contained in the inventive composition. Exemplary second (betaine) surfactants include alkyl betaine, alkylamidopropyl betaine, and imidozolinium betaine. An embodiment of the brightening and cleaning composition of the invention contains from 0.1 to 0.5 g/l of betaine. The behavior of betaine in solution is very complicated, and may be cationic or amphoteric. The present invention utilizes betaine, and the relative proportion of betaine, to select for and control the etching speed or rate of the resulting composition. While included in the group of second surfactants, if included as one or more first surfactants, the concentration (g/l) ranges described for the first surfactant should be correspondingly adjusted.

An embodiment of the brightening and cleaning composition of the invention contains from 1.6 to 16.3 g/l of an alkali metal hydroxide. Exemplary and preferred alkali metal hydroxides include sodium hydroxide or potassium hydroxide. Lithium hydroxide or a mixture of the foregoing may also be used in the inventive composition.

As indicated above, an embodiment of the brightening and cleaning composition of the invention contains from 0.9 to 9.4 g/l of a polycarboxylic acid. Exemplary and preferred such polycarboxylic acids are ethylenediaminetetraacetic acid (EDTA), nitrilotriacetic acid (NTA), propylene-1,2-diaminotetra-acetic acid (PDTA), hydroxyethylethylenedianine triacetic acid (HEDTA), or diethylenetriaminepentaacetic acid (DTPA).

An embodiment of the brightening and cleaning composition of the invention contains from 1.4 to 14.3 g/l of an alkali metal salt of an organic acid. Exemplary and preferred such metal salts include $C_5H_9O_6Na$, $C_6H_{11}O_7Na$ (sodium gluconate), $C_7H_{13}O_8Na$ (sodium glucoheptonate), or $C_8H_{15}O_9Na$.

The pH of the various embodiments of the brightening and cleaning composition of the invention is greater than 10; typically, the pH is in a range from 12 to 14. In selected embodiments, the pH range is from 12.3 to 13.2.

In a first selected embodiment, the inventive brightening and cleaning composition comprises, approximately by weight/liter of active ingredients:

(a) from 4.2 to 14.6 g/l of an alkali metal hydroxide, such as 8.2 g/l sodium hydroxide;

(b) from 2.1 to 7.8 g/l of a polycarboxylic acid, such as 4.7 g/l EDTA;

(c) from 1.8 to 13.5 g/l of an alkali metal salt of an organic acid, such as 7.2 g/l sodium glucoheptonate;

(d) from 0.2 to 1.6 g/l of a nonionic surfactant, such as 0.9 g/l;

(e) from 0.1 to 3.2 g/l of an amphoteric surfactant, such as 1.5 g/l; and (f) from 0.15 to 0.45 g/l of a betaine surfactant, such as 0.17 g/l.

As mentioned above, it will be understood by those of skill in the art that equivalent units of measurements may be substituted and are within the scope of the present invention.

It should also be noted that the weight amounts listed above are for a concentrated solution. It will also be understood by those of skill in the art that the composition of the invention may be diluted to any desired strength, preferably by water, throughout a wide range. It should also be noted that in its bulk formulation, based upon how the various components are supplied, the inventive composition comprises, approximately by weight:

(a) from 6 to 30 g/l of an alkali metal hydroxide, such as 16.3 g/l sodium hydroxide;

(b) from 3 to 18 g/l of a polycarboxylic acid, such as 9.4 g/l EDTA;

(c) from 6 to 30 g/l of an alkali metal salt of an organic acid, such as 14.3 g/l sodium glucoheptonate;

(d) from 0.5 to 4 g/l of a nonionic surfactant, such as 0.9 g/l;

(e) from 0.3 to 8 g/l of an amphoteric surfactant, such as 4.1 g/l; and (f) from 0.3 to 2 g/l of a betaine surfactant, such as 0.5 g/l.

In another aspect, the present invention provides a composition for cleaning aluminum and other metals, as well as other types of materials likely to be found on the exterior surface of large vehicles so that the metallic surfaces of a large transportation vehicle may be cleaned without adversely affecting surfaces in close proximity to the metallic surface that can not conveniently be protected from contact with the inventive composition. The inventive composition may be utilized as part of a multi-step cleaning process comprising: a first application step of applying an acidic composition; followed by a variable dwell time; followed by the second application step of applying the brightening and cleaning composition of the invention; followed by a variable dwell time; and then followed by high pressure water rinse. The duration of application of either the acidic composition or inventive composition, or the dwell times may be highly variable, depending on the application, and other factors as described below. Two significant variables include, first, the concentration of the detergents being applied, and second, the ratio between the acidic composition pH in the first step compared to the alkaline composition of the second step of the process. Other factors include water temperature, composition temperature, vehicle surface temperature, water softening, water pressure, types of sprays and nozzles utilized, distance from the sprays, and the gallons per minute of solution applied.

As mentioned above, comparison experiments were performed utilizing this exemplary brightening and cleaning composition of the invention. The various exemplary brightening and cleaning compositions of the invention provided unexpectedly favorable empirical results in comparison with the compositions of the prior art, resulting in exceptional aluminum brightening capability, with etching improvement of well over 300% for the inventive composition in diluted form (1:10 to 1:15).

Various embodiment of the inventive composition were compared to the compositions of Dollman et al., U.S. Pat. No. 4,762,638 and its referenced patent applications, Ser. No. 273,484 and Ser. No. 383,289. Etching was measured as a change in sample weight (in mg) per unit area of surface ($cm^2$), multiplied by the etching time (in minutes) (($mg/cm^2$)×min).

U.S. Patent Applications Ser. Nos. 273484 and 383289 disclosed the following composition:

1. Alkali metal hydroxide, 0.5 to 3 g/l;
2. Alkali metal salt of EDTA, 1 to 5 g/l;
3. At least one anionic, cationic or nonionic surfactant 0.1 to 10 g/l (polyethoxylated straight chain alcohol—2 parts, linear alkyl succinate—1 part, optionally alkali metal salt of 2-butoxyetoxyacetate); and
4. Sodium glucoheptonate, 0.6 to 1.3 g/l.

The following prior art (PA) formulations were tested, with corresponding etching results, with the balance of the compositions being water (Table 1):

| | Concentration, g/l | |
|---|---|---|
| Components: | PA-1 | PA-2 |
| 1. Sodium Hydroxide | 0.5 | 1.5 |
| 2. Sodium EDTA | 1 | 2.5 |
| 3. Nonionic and anionic surfactants (alcohol ethoxylate, 2 parts, alkyl succinate, 1 part) | 0.1 | 5 |
| 4. Sodium glucoheptonate | 0.6 | 1 |
| Parameters: | | |
| pH | 11.84 | 12.49 |
| Etching (($mg/cm^2$) × min) | 0.020 | 0.082 |

Somewhat better etching results could be obtained with this formulation by significantly increasing the concentration (5-600% for PA-1 and 200% for PA-2), and by increasing the pH to be well outside of the range of the specifications.

U.S. Pat. No. 4,762,638 disclosed the following composition:

1. Alkali metal salt of EDTA or NTA, 0.1 to 8 gi
2. At least one anionic, cationic or nonionic surfactant, 0.1 to 10 g/l;
3. Inorganic alkali metal phosphate (STPP, etc.), 0.1 to 20 g/l;
4. Alkali metal hydroxide for pH 11 to 12.5, up to 5 g/l; and
5. Second inorganic salt in 1 the amount of inorganic metal phosphate with a second aluminum sequestering agent, 0 to 10 g/l.

The following formulations were tested, with corresponding etching results, with the balance of the compositions being water (Table 2):

| | Concentration, g/l | |
|---|---|---|
| Components: | PA-3 | PA-4 |
| 1. Alkali metal salt of EDTA or NTA: | | |
| Sodium EDTA | 0.1 | |
| Sodium NTA | | 5 |
| 2. Nonionic or anionic surfactants: alkyl sulfonate | 0.1 | 5 |
| 3. Alkali metal phosphate | | |
| sodium phosphate | 0.1 | |
| potassium pyrophosphate | | 10 |
| 4. Sodium hydroxide | 0 | 2 |
| 5. Sodium gluconate | 0 | 5 |
| Parameters: | | |
| pH | 11.31 | 12.31 |
| Etching (($mg/cm^2$) × min) | 0.003 | 0.069 |

Somewhat better etching results could be obtained with a variation of these formulations (utilizing sodium tripolyphosphate as the alkali metal phosphate and alcohol ethoxylate for the nonionic or anionic surfactant), again, by significantly increasing the concentration (2-300% for PA-4), and by increasing the pH to be well outside of the range of the specification.

Referring to the first embodiment of the inventive composition disclosed above, the following compositions were implemented and tested, and further provide examples of the composition of the present invention. As illustrated below in Table 3, even very dilute formulations of the inventive (I) compositions achieved improved etching results of over 300%.

The following exemplary compositions were made by mixing the listed ingredients in the listed proportions. All proportions are concentrations in g/l, with the balance of the compositions being water. Excellent etching rates and brightening performance (and cleaning performance) were achieved with these compositions, both under concentrated and diluted conditions (Table 3):

| Components: | | | | | Concentration, g/l | | | | | |
|---|---|---|---|---|---|---|---|---|---|---|
| | | | | | I-1 | I-2 | I-3 | I-4 | I-5 | I-6 |
| 1. Alkali metal hydroxide | | | | | | | | | | |
| sodium hydroxide | | | | | | 8 | 16 | 8.2 | 8.2 | 8.2 |
| potassium hydroxide | | | | | 1.6 | | | | | |
| 2. Polycarboxylic Acid | a | b | c | d | | | | | | |
| EDTA | 0 | 2 | 2 | 4 | 0.9 | | 9 | | | |
| NTA | 0 | 1 | 0 | 3 | | 4 | | | | |
| PDTA | 0 | 2 | 3 | 4 | | | | 3.8 | | |
| HEDTA | 1 | 2 | 2 | 3 | | | | | 3.8 | |
| DTPA | 0 | 3 | 4 | 5 | | | | | | 3.8 |
| 3. An alkali salt of organic acid | n | | | | | | | | | |
| Sodium glucoheptonate | 7 | | | | 1.4 | 8 | | 7.2 | 7.2 | 7.2 |
| Sodium gluconate | 6 | | | | | | 14 | | | |
| 4. Nonionic surfactant | | | | | 0.1 | 1 | 1.8 | 1 | 1 | 1 |
| 5. Betain | | | | | | 0.1 | 0.3 | 0.1 | 0.1 | 0.1 |
| 6. Amphoteric surfactant | | | | | 0.03 | 0.9 | 3 | 0.9 | 0.9 | 0.9 |
| Parameters: | | | | | | | | | | |
| pH | | | | | 12.38 | 13.00 | 13.14 | 12.89 | 12.98 | 12.92 |
| Etching ((mg/cm$^2$) × min) | | | | | 0.06 | 0.185 | 0.233 | 0.172 | 0.125 | 0.188 |

As may be apparent from these empirical results, the compositions of the present invention resulted in highly unexpected results, with improved etching performance at low concentrations, on the order of 300% to 400% compared to prior art formulations. For example, formulation I-1 had three times greater performance (i.e. a 200 percent increase) than PA-1 and a twenty times greater performance (i.e. an almost 2,000% increase) than PA-3; formulations I-2, I-4 and I-6 had two and one-half to three times greater performance than PA-2 and PA-4 (i.e an about 100% to about 172 percent increase); and formulation 1-3 had a three to four times greater performance (i.e. about a 180% to 240% increase) than PA-2 and PA-4. In addition, it is apparent that these other formulations teach away from the present invention, as they show moderate improvement only at very high concentrations and at very high pH (outside of their specified ranges), with 1-3 still providing approximately 200% better etching performance over increased concentrations of PA-2 and PA-4 (200% increased concentrations). Additional significant results are illustrated below in Table 7, and also show dramatic improvement compared to the prior art, on the order of 400% to 600% etching improvement.

As indicated above, a need remains for an aluminum and other metal brightener and cleaner that will also clean materials in close proximity to the metal without damaging these materials. The various embodiments of the inventive composition may be used, without detrimental effect, to clean other components such as glass, painted surfaces, rubber, plastic, brass, fiberglass, particularly those found in close proximity to metallic surfaces on large vehicles, and may also have applications for other surface cleaning, such as for surfaces adjacent to or comprising wood, brick and stone.

In comparability tests involving measurement of weight change and visual observation after a 72 hour time period of exposure, for clean rubber seals, rubber sheets, silver coated and brass electrical contacts connectors, the results outlined in Tables 4 and 5 were obtained. The inventive composition was used in dilution ratios of 1:15 and 1:50. A very small loss in weight for the contacts and connector indicates only cleaning of these parts. Visual observation found no trace of corrosion or damage for these parts. A very small gain in weight for rubber seals and bigger gain for rubber sheets indicates slight swelling effect, which is typical for the rubber parts in alkaline solutions. Visual observation found no damage or changes in physical properties for these parts.

TABLE 4

Aluminum Brightener @ Dilution Ratio 1:15, 72 Hour Material Compatability Test Formulation I-2:

| Vial Number | Part Number | Type of Material | Initial Weight | Final Weight | % Loss/Gain (−/+) |
|---|---|---|---|---|---|
| 1 | 1 | Rubber Seal | 1.0891 | 1.0892 | 0.01 |
| 2 | 1 | Rubber Seal | 1.2196 | 1.2196 | 0.00 |
| 3 | 2 | Silver Contact | 6.2263 | 6.2245 | −0.03 |
| 4 | 2 | Silver Contact | 6.2639 | 6.2629 | −0.02 |
| 5 | 3 | Brass Contact | 6.1720 | 6.1714 | −0.01 |
| 6 | 3 | Brass Contact | 6.2143 | 6.2132 | −0.02 |
| 7 | 4 | Rubber Sheet | 3.1275 | 3.1434 | 0.51 |
| 8 | 4 | Rubber Sheet | 2.4775 | 2.4908 | 0.54 |
| 9 | 5 | Connect | 2.7242 | 2.7219 | −0.08 |
| 10 | 5 | Connect | 3.3181 | 3.3157 | −0.07 |

TABLE 5

| Aluminum Brightener @ Dilution Ratio 1:50, 72 Hour Material Compatability Test Formulation I-3: | | | | | |
|---|---|---|---|---|---|
| Vial Number | Part Number | Type of Material | Initial Weight | Final Weight | % Loss/Gain (−/+) |
| 11 | 1 | Rubber Seal | 1.2017 | 1.2024 | 0.06 |
| 12 | 1 | Rubber Seal | 1.1814 | 1.1817 | 0.03 |
| 13 | 2 | Silver Contact | 6.2282 | 6.2268 | −0.02 |
| 14 | 2 | Silver Contact | 6.2351 | 6.2347 | −0.01 |
| 15 | 3 | Brass Contact | 6.2538 | 6.2532 | −0.01 |
| 16 | 3 | Brass Contact | 6.2024 | 6.2018 | −0.01 |
| 17 | 4 | Rubber Sheet | 3.2429 | 3.2626 | 0.61 |
| 18 | 4 | Rubber Sheet | 2.4970 | 2.5131 | 0.64 |
| 19 | 5 | Connect | 2.7182 | 2.7170 | −0.04 |
| 20 | 5 | Connect | 2.9057 | 2.9049 | −0.03 |

The inventive composition may also be used to clean windows, other glass and coated glass. In compatibility tests involving measurement of weight change and visual observation after a 72 hour time period of exposure, the results outlined in Table 6 were obtained. The inventive composition was used in dilution ratios of 1:10, 1:15 and 1:40. A very small gain in weight indicates a slight swelling effect mostly from water as more concentrated solutions have less gain in weight. Visual observation found no damage or changes in physical properties for these parts.

TABLE 6

| Aluminum Brightener 72 Hour Material Compatability Test Formulation I-2: | | | | | |
|---|---|---|---|---|---|
| Vial Number | Dilution | Type of Material | Initial Weight | Final Weight | % Loss/ Gain (−/+) |
| 1 | 1:10 | Shatter resistant plastic window | 1.9430 | 1.9437 | 0.04 |
| 2 | 1:10 | Shatter resistant plastic window | 2.0438 | 2.0449 | 0.05 |
| 3 | 1:15 | Shatter resistant plastic window | 2.1172 | 2.1190 | 0.09 |
| 4 | 1:15 | Shatter resistant plastic window | 1.7867 | 1.7879 | 0.07 |
| 5 | 1:40 | Shatter resistant plastic window | 2.0484 | 2.0511 | 0.13 |
| 6 | 1:40 | Shatter resistant plastic window | 1.7415 | 1.7435 | 0.11 |

As indicated above, the inventive composition also serves as an aluminum brightener, as well as a brightener for other metallic surfaces. In a test involving exposure of a metallic surface to the inventive composition for a five minute period, surface gloss change and weight change were measured and the etching was calculated. Material for the test came from aluminum train skin samples. The inventive composition of 1-3 was used in its capacity as an aluminum brightener in a dilution ratio of 1:15. Test results are summarized in Table 7. Test results indicate that the aluminum brightener provides high-speed etching at a dilution ratio of 1:15.

The procedure utilized for calculating etching rates included a temperature of 108 degrees Fahrenheit and an etching duration of 5 minutes. The testing surface was 22.2 square centimeters, and included two skin samples of A/B train car side.

TABLE 7

| Detergent Dilution ratio | Skin Sample | Initial Gloss, units | Final Gloss, units | Etching, mg/sq. cm × min |
|---|---|---|---|---|
| Aluminum Brightener 1:15 | 1 | 5.6 | 23.3 | 0.408 |
| Aluminum Brightener 1:15 | 2 | 8.0 | 28.9 | 0.340 |

As mentioned above, the inventive composition may be used as part of a multi-step cleaning process, consisting of applying a first, acidic detergent followed by a variable dwell time; and applying the composition of the present invention, followed by a variable dwell time, followed by rinsing with high pressure water. Exemplary such acidic compositions are disclosed in V. Chemin et al., U.S. Pat. No. 6,696,399 B1, issued Feb. 24, 2004, and include acidic compositions comprising at least one anionic surfactant; at least one nonionic surfactant; an emulsifier; a hydrotrope; a hydroxycarboxylic acid; a terpene solvent; and water.

In one exemplary embodiment, the low pH, noncorrosive detergent of this multi-step method comprises, approximately by percentage weight: (a) 1% to 3% of a co-emulsifier, such as a salt of citric acid, including sodium citrate and potassium citrate; (b) an anionic surfactant, such as 2% to 8% of an alkyl benzyl sulfonate, as a surface active agent; (c) a hydrotrope (and emulsifier) such as 0.5% to 5% of sodium xylene sulfonate in a 30% solution or in a powder form, as a surface active agent; (d) a nonionic surfactant, such as 1.5% to 9% ethoxylated alkyl phenol, as a surface active agent; (e) a co-solvent, such as 0.5% to 4% glycol ether, such as diethylene glycol monobutyl ether; (f) an anionic surfactant such as 1.5% to 10% complex alkyl phosphate ester, as a surface active agent; (g) an organic acid, such as 5% to 25% hydroxycarboxylic acid, such as glycolic acid, citric acid, or lactic acid; (h) a terpene solvent, such as 2% to 20% d-limonene; and (i) the balance being water. It will be understood by those of skill in the art that equivalent units of measurements, such as by molarity or morality, may be substituted and are within the scope of the present invention.

It should also be noted that the percentages listed above are for a concentrated low pH solution. It will also be understood by those of skill in the art that this first, acidic detergent composition may be diluted to any desired strength, preferably by water, throughout a wide range. The acidic detergent composition should have, as a minimum, roughly or approximately 30% to 40% (and preferably a minimum of 36%) water by weight to form an emulsion (rather than a gel) (and not including water which may be part of the other ingredients, such as within a 70% glycolic acid solution). In typical applications, this acidic detergent composition may be diluted in a range extending as much as 200 times (0.5% detergent in water). For example, in a typical automobile wash environment, the concentrated acidic detergent may be diluted on a scale of 1 part detergent to 80 parts water, and applied to a vehicle.

As may be apparent from the discussion above, the present invention provides a highly effective, aluminum brightening and cleaning composition, providing considerably greater effectiveness at a lower concentration. Moreover, the brightening and cleaning composition may be used to clean other surfaces in close proximity to metallic surfaces without adversely affecting these other surfaces. The brightening and cleaning composition may be utilized in a wide variety of applications, such as brightening metallic surfaces of large vehicles. The composition may also be utilized as part of a multi-step cleaning process in conjunction with an acidic composition.

From the foregoing, it will be observed that numerous variations and modifications may be effected without departing from the spirit and scope of the novel concept of the invention. It is to be understood that no limitations with respect to the specific methods and apparatus illustrated herein is intended or should be inferred. It is, of course, intended to cover by the appended claims all such modifications as fall within the scope of the claims.

We claim:

1. An alkaline brightening and cleaning composition for metal surfaces, the composition providing etching of aluminum without adversely effecting other, non-metallic surfaces, comprising:

an alkali metal hydroxide having a concentration of substantially 1.6 to 16 g/l;

a polycarboxylic acid having the formula $(CH_2CH_2O)_aN_b(CH_2)_c(CH_2COOH)_d$, wherein a is from 0 to 1, b is from 1 to 3, c is from 0 to 4 and d is from 3 to 5 and having a concentration of substantially 0.9 to 9 g/l;

an alkali metal salt of an organic acid selected from the group consisting of sodium gluconate and sodium glucoheptonate having a concentration of substantially 1.4 to 14 g/l;

a first, amphoteric surfactant having a concentration of substantially 0.03 to 3 g/l;

a second, betaine surfactant;

a third, nonionic surfactant, the second betaine surfactant and the third nonionic surfactant having a combined concentration of substantially 0.1 to 1.8 g/l; and the balance being water, wherein the ratio of the alkali metal hydroxide or the alkali metal salt of an organic acid to the polycarboxylic acid is substantially from 0.6:1 to 6:1.

2. An alkaline brightening and cleaning composition for metal surfaces, the composition providing etching of aluminum without adversely effecting other, non-metallic surfaces, comprising:

an alkali metal hydroxide having a concentration of substantially 4.2 to 14.6 g/l;

a polycarboxylic acid having the formula $(CH_2CH_2O)_aN_b(CH_2)_c(CH_2COOH)_d$, wherein a is from 0 to 1, b is from 1 to 3, c is from 0 to 4 and d is from 3 to 5 and having a concentration of substantially 2.1 to 7.8 g/l;

an alkali metal salt of an organic acid selected from the group consisting of sodium gluconate and sodium glucoheptonate having a concentration of substantially 1.8 to 13.5 g/l;

a first, nonionic surfactant having a concentration of substantially 0.2 to 1.6 g/l;

a second, amphoteric surfactant having a concentration of substantially 0.1 to 3.2 g/l; and a third, betaine surfactant having a concentration of substantially 0.15 to 0.45 g/l, wherein the ratio of the alkali metal hydroxide or the alkali metal salt of an organic acid to the polycarboxylic acid is substantially from 0.6:1 to 6:1.

3. An alkaline brightening and cleaning composition for metal surfaces, the composition providing etching of aluminum without adversely effecting other, non-metallic surfaces, comprising:

an alkali metal hydroxide having a concentration of substantially 6 to 30 g/l;

a polycarboxylic acid having the formula $(CH_2CH_2O)_aN_b(CH_2)_c(CH_2COOH)_d$, wherein a is from 0 to 1, b is from 1 to 3, c is from 0 to 4 and d is from 3 to 5 and having a concentration of substantially 3 to 18 g/l;

an alkali metal salt of an organic acid selected from the group consisting of sodium gluconate and sodium glucoheptonate having a concentration of substantially 6 to 30 g/l;

a first, nonionic surfactant having a concentration of substantially 0.5 to 4 g/l;

a second, amphoteric surfactant having a concentration of substantially 0.3 to 8 g/l; and a third, betaine surfactant having a concentration of substantially 0.3 to 2 g/l, wherein the ratio of the alkali metal hydroxide or the alkali metal salt of an organic acid to the polycarboxylic acid is substantially from 0.6:1 to 6:1.

4. The composition of claim 1, wherein the nonionic surfactant is one or more of the following: ethoxylated C8-C18 alkylphenols or condensation products of higher alcohol condensed with about 2 to 14 moles of ethylene oxide ("EO"); lauryl or myristyl alcohol condensed with 6 moles of ethylene oxide; tridecanol condensed with about 2 to 20 moles of EO; the condensation product of EO with a cut of coconut fatty alcohols with alkyl chain varying from 10 to about 14 carbon atoms in length and wherein, in condensate, contains either about 2 moles of EO per mole of total alcohol or about 20 moles of EO per mole of alcohol; ethoxylates which are alpha-(alkylphenol) containing about 9-15 carbon atoms/molecule; nonylphenol condensed with 2-3 moles of ethylene oxide; nonylphenol condensed with 8-9 moles of EO; oil soluble alcohol ethylene oxide condensates; condensation products of secondary aliphatic alcohol containing 8 to 18 atoms/molecule in a straight or branched chain configuration condensed with 2 to 20 moles of EO; C11-C15 secondary alcohol condensed with either 5 EO or 9 EO; higher aliphatic, primary alcohol containing 9-15 carbon atoms/molecule condensed with 2-4 moles of ethylene oxide; C12-C15 alcohol condensed with 2-4 moles of EO; or C14-C15 linear primary alcohol condensed with 2-3 moles of ethylene oxide.

5. The composition of claim 1, wherein the first, amphoteric surfactant is one or more of the following: alkylamidopropyl hydroxysultaine, alkylamidopropyl hydroxyphostaine; N-alkyl derivatives of amino acids or imino acids; alkyl aminopropionic acid, alkali salt of alkylglycinate, aminopropyl alkylglutamide, alkali salt of alkyliminodipropionate; acyl ethylenediamines or acyl ethylenediamines derivatives; acylamphoacetate; acylamphodiacetate; or acylamphodipropionate.

6. The composition of claim 1, wherein the betaine surfactant is one or more of the following: alkyl betaine, alkylamidopropyl betaine, or imidozolinium betaine.

7. The composition of claim 1, wherein the polycarboxylic acid is ethylenediaminetetraacetic acid (EDTA), nitrilotriacetic acid (NTA), propylene-1,2-diaminotetra-acetic acid (PDTA), hydroxyethylethylenediamine triacetic acid (HEDTA), or diethylenetriaminepentaacetic acid (DTPA).

8. The composition of claim 1 wherein the pH is 12 to 13.2.

9. The composition of claim 1, wherein the ratio of the alkali metal hydroxide to the polycarboxylic acid is substantially 2:1.

10. The composition of claim 1, wherein the alkali metal salt of an organic acid and the polycarboxylic acid are present in a ratio that is substantially from 0.6:1 to 6:1.

11. The composition of claim 1, wherein the ratio of the alkali metal salt of an organic acid to the polycarboxylic acid are present in a ratio that is substantially 2:1.

12. The composition of claim 2, wherein the ratio of the alkali metal salt of an organic acid to the polycarboxylic acid is substantially 2:1.

13. The composition of claim 2, wherein the second surfactant in a nonionic surfactant that is one or more of the following: ethoxylated C8-C18 alkylphenols or condensation products of higher alcohol condensed with about 2 to 14 moles of ethylene oxide ("EO"); lauryl or myristyl alcohol condensed with 6 moles of ethylene oxide; tridecanol condensed with about 2 to 20 moles of EO; the condensation product of EO with a cut of coconut fatty alcohols with alkyl chain varying from 10 to about 14 carbon atoms in length and wherein, in condensate, contains either about 2 moles of EO per mole of total alcohol or about 20 moles of EO per mole of alcohol; ethoxylates which are alpha-(alkylphenol) containing about 9-15 carbon atoms/molecule; nonylphenol condensed with 2-3 moles of ethylene oxide; nonylphenol condensed with 8-9 moles of EO; oil soluble alcohol ethylene oxide condensates; condensation products of secondary aliphatic alcohol containing 8 to 18 atoms/molecule in a straight or branched chain configuration condensed with 2 to 20 moles of EO; C11-C15 secondary alcohol condensed with either 5 EO or 9 EO; higher aliphatic, primary alcohol containing 9-15 carbon atoms/molecule condensed with 2-4 moles of ethylene oxide; C12-C15 alcohol condensed with 2-4 moles of EO; or C14-C15 linear primary alcohol condensed with 2-3 moles of ethylene oxide and has a concentration of substantially 0.1 g/l to 1.8 g/l.

14. The composition of claim 2, wherein the first, amphoteric surfactant is one or more of the following: alkylamidopropyl hydroxysultaine, alkylamidopropyl hydroxyphostaine; N-alkyl derivatives of amino acids or imino acids; alkyl aminopropionic acid, alkali salt of alkylglycinate, aminopropyl alkylglutamide, alkali salt of alkyliminodipropionate; acyl ethylenediamines or acyl ethylenediamines derivatives; acylamphoacetate; acylamphodiacetate; or acylamphodipropionate.

15. The composition of claim 2, wherein the betaine surfactant is one or more of the following: alkyl betaine, alkylamidopropyl betaine, or imidozolinium betaine.

16. The composition of claim 2, wherein the alkali metal hydroxide is sodium hydroxide or potassium hydroxide, and wherein the alkali metal hydroxide has a concentration of substantially 1.6 g/l to 16.3 g/l.

17. The composition of claim 2, wherein the polycarboxylic acid is ethylenediaminetetraacetic acid (EDTA), nitrilotriacetic acid (NTA), propylene-1,2-diaminotetra-acetic acid (PDTA), hydroxyethylethylenediamine triacetic acid (HEDTA), or diethylenetriaminepenaacetic acid (DTPA).

18. The composition of claim 2 wherein the pH is 12 to 13.2.

* * * * *